United States Patent [19]

Iwamitsu et al.

[11] 4,041,713

[45] Aug. 16, 1977

[54] METHOD AND APPARATUS FOR STARTING A TUNNELING MACHINE FROM AN INITIAL PLACEMENT WITHIN A VERTICAL SHAFT SUNK INTO THE GROUND AND PROVIDED WITH A STARTING PORT

[75] Inventors: Yasuyuki Iwamitsu, Ichikawa; Kataro Taira, Tokyo, both of Japan

[73] Assignee: Tekken Construction Co. Ltd., Tokyo, Japan

[21] Appl. No.: 730,866

[22] Filed: Oct. 8, 1976

[30] Foreign Application Priority Data

Mar. 8, 1976 Japan ..... 51-24076

[51] Int. Cl.[2] ..... E01G 3/04

[52] U.S. Cl. ..... 61/42; 61/84

[58] Field of Search ..... 61/84, 85, 42, 41, 41 A, 61/45, 63; 425/159, 163

[56] References Cited

U.S. PATENT DOCUMENTS

| | | | |
|---|---|---|---|
| 438,509 | 10/1890 | Vering | 61/84 |
| 742,222 | 10/1903 | O'Rourke | 61/42 |
| 1,296,312 | 3/1919 | O'Rourke | 61/85 |
| 1,796,752 | 3/1931 | Goodrich | 61/85 |
| 2,669,441 | 2/1954 | Castanoli et al. | 61/84 X |
| 3,005,314 | 10/1961 | Cunningham | 61/84 X |
| 3,299,643 | 1/1967 | Mauclet | 61/45 R X |

FOREIGN PATENT DOCUMENTS

| | | | |
|---|---|---|---|
| 927,875 | 11/1947 | France | 61/84 |

*Primary Examiner*—Dennis L. Taylor

*Attorney, Agent, or Firm*—Pierce, Scheffler & Parker

[57] ABSTRACT

A method of and apparatus for starting a tunneling operation into a soft ground having a high water content or much gushing water while preventing any collapse of the ground or outflow of water. The tunneling machine is initially placed within a vertical shaft in the ground and a sheet pile is struck into the ground between a retaining wall of the shaft having a starting port through which the machine is to be ultimately advanced into the surrounding ground after the port is opened by raising the pile. A ring-shaped liquid-tight packing is applied to the retaining wall and surrounding the starting port engages the periphery of the head portion of the tunneling machine to form part of a liquid-pressurized chamber in front of the machine, the pressure in the chamber being at least as high as the surrounding underground water or ground pressure when the port is opened and the machine is then started through the port.

17 Claims, 2 Drawing Figures

Figure 1:
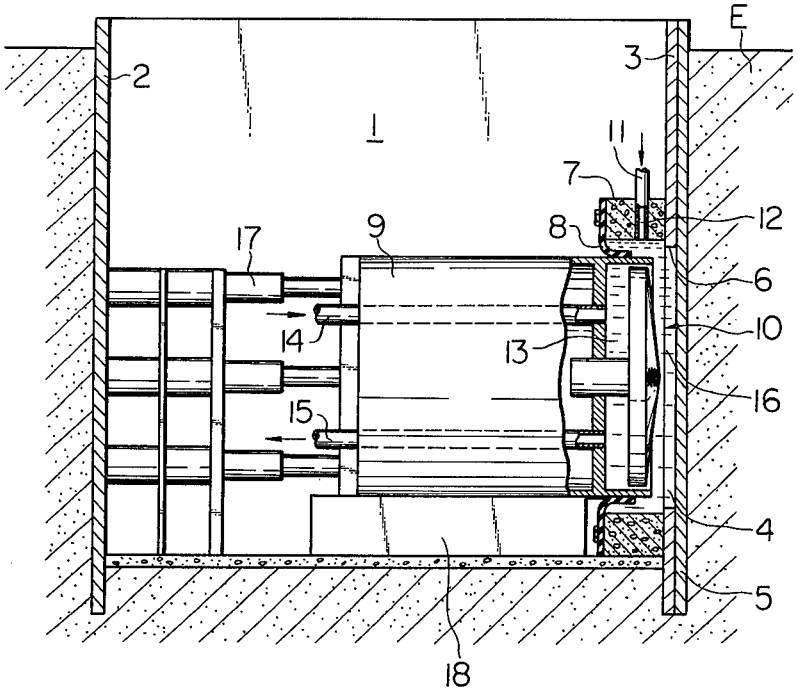

METHOD AND APPARATUS FOR STARTING A TUNNELING MACHINE FROM AN INITIAL PLACEMENT WITHIN A VERTICAL SHAFT SUNK INTO THE GROUND AND PROVIDED WITH A STARTING PORT

The present invention relates to a method of starting propulsion of a tunneling machine into a soft ground at a tunnel starting point and an apparatus to be used for performing the method and, more particularly, to a method of starting a propulsion of a tunneling machine into a soft ground having a high water content or much gushing water from an initial placement within a vertical shaft provided at a starting point of a tunnel through the ground while keeping the ground stable and a slurry and mud sealing apparatus for performing the method. The tunneling machine with which the invention is concerned is of the generally known type wherein an advancing pressurized liquid, e.g., a slurry, chamber is maintained in front of the tunneling head of the machine as it bores its way through the earth.

In conventional methods of starting the tunneling with the tunneling machine of the kind referred to into the soft ground which easily causes collapses and water-gushes to occur once made unstable, one side wall of a vertical shaft preliminarily made at a tunnel starting point in such ground is made a starting port for the machine and, in the case wherein a sheet pile struck in advance into the ground at the starting port as a retaining wall is to be removed prior to the starting of the tunneling machine, such auxiliary processes as a chemical grout impregnation, CCP, underground water level reduction, ground water freezing or the like must be carried out in order to prevent any ground collapse and gushing water and thereafter the sheet pile removing work is carried out. However, due to various natural conditions of the ground or the like, the days required for determining and performing such an auxiliary process are so many that the work period is undesirably and the work cost is high. And yet, such auxiliary processes have been indispensable particularly, for example, in the case of driving a tunnel for public facilities underneath cities located very low comparatively to the sea level. The present invention is suggested to provide a simple and safe starting method of the kind referred to by eliminating these defects of the conventional methods.

According to the present invention, a sheet pile is struck into the ground between the ground and a retaining wall having a tunneling machine starting port in a vertical shaft, a ring-shaped water-tight sealing means is fitted to an end edge part surrounding the starting port of the retaining wall, a space is formed by the front end of the tunneling machine, sealing means, starting port and sheet pile, said space is made a pressurized liquid chamber by feeding a slurry, muddy water or simply water under a pressure elevated to be as high as or higher than the underground water pressure or the ground pressure, thereafter the sheet pile is pulled up and the tunneling machine is propelled into the ground through the starting port and pressurized liquid chamber so that the above described defects will be successfully eliminated.

A primary object of the present invention is to provide a highly efficient method and apparatus for starting tunneling with a tunneling machine of the general type described wherein any auxiliary process heretofore required to be performed prior to the starting of the tunneling machine into the soft ground having a high water content or much gushing water can be omitted.

Another object of the present invention is to provide a simple and safe method and apparatus for starting a tunneling machine of the general type described into a high water content ground or the like.

Figure 2:
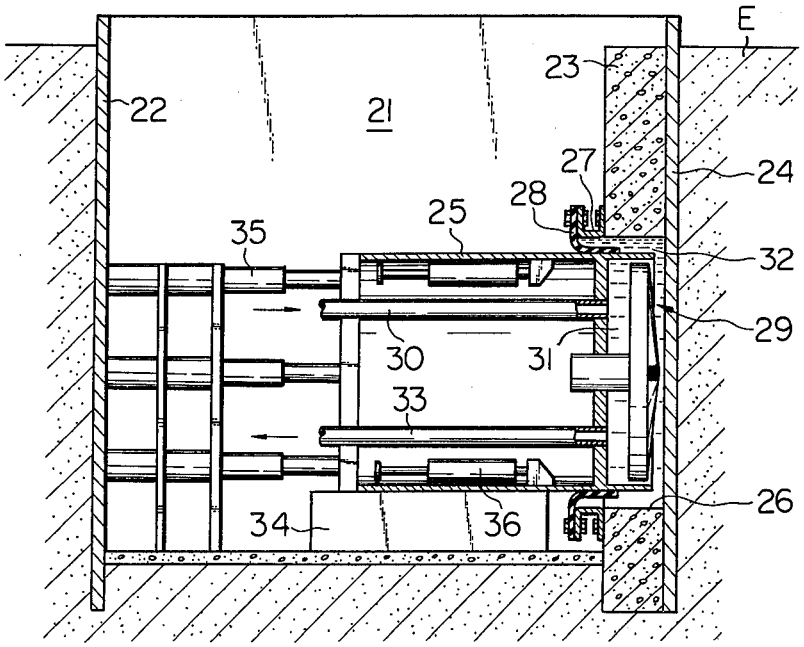

Other objects and advantages of the present invention will become clear upon reading the following detailed explanation of preferred embodiments of the present invention shown in accompanying drawings, in which:

FIG. 1 is a schematic sectioned view of a vertical shaft and its tunneling machine starting port for showing an embodiment of the present invention, in which the relation between the tunneling head of the tunneling machine and the starting port is shown; and FIG. 2 is substantially the same sectioned view as FIG. 1, showing another embodiment of the present invention, the tunneling machine being shown in a schematic sectioned view.

Referring to FIG. 1, sheet piles 2 and 3 are struck into the ground to form a retaining wall along the peripheral wall surface of a vertical shaft 1 dug in a soft ground E of, for example, a high water content but the sheet pile or piles 3 on the side facing the tunneling starting direction has a starting port 4 substantially circular in this case of a diameter proper enough to pass a tunneling machine. Another sheet pile 5 is struck and overlapped outside said starting port 4 to initially close the starting port. The sheet piles 3 and 5 are struck deeply until the lower ends pass the bottom surface of the vertical shaft. A substantially ring-shaped concrete block 7 is liquid-tightly fixed or cast inside the vertical shaft along the peripheral edge of the starting port 4 in the sheet pile 3 so as to form a starting shaft port 6. The lower end of the block 7 reaches the bottom surface of the vertical shaft or is preferably positioned in the ground deeper than that. A packing 8, for example, of a flexible rubber material is fixed to the peripheral edge of the shaft port 6 inside the concrete block 7 so as to extend by a proper length toward the center of the shaft port 6. As described later, when the tunneling head of the tunneling machine 9 positioned on the bottom of the vertical shaft is inserted into the starting shaft port 6 through the packing 8, a substantially liquid-tight space 10 is defined by the head of the tunneling machine 9, packing 8, concrete block 7 and sheet piles 3 and 5. In the case of this embodiment, a slurry or water leading path 12 is formed by a pipe 11 for communicating the space 10 with the exterior through the concrete block 7 and the space 10 is made a pressurized liquid chamber by pouring a slurry, muddy water or simply water 16 under an elevated pressure into the space 10 through said liquid leading path 12 so that the water pressure on the front surface of the tunneling machine 9 at the time of starting the machine into the ground will be kept stable and any danger of the soft ground collapse or outflow of gushing water at the shaft port 6 will be prevented. The liquid pressure in the pressurized liquid chamber 10 may be kept either in cooperation with the operations of feeding and draining a slurry or muddy water under an elevated pressure for tunneling from the exterior to a liquid pressure chamber 13 provided at the head part of the tunneling machine 9 through a feed pipe 14 and an outlet pipe 15 or separately only through the liquid leading path 12, or even by the slurry or muddy water fed to the tunneling face through the pipe 14 and through the machine head by omitting the liquid leading path 12.

The tunneling machine 9 is mounted on a machine base 18 fixed on the bottom surface of the vertical shaft 1 and is propelled by a group of propelling jacks 17 set on the shaft wall side opposed to the shaft port 6 through this port and into the earth after pile 5 has been removed so as to open the port.

In the other embodiment of the present invention shown in FIG. 2, the same as in the embodiment in FIG. 1, sheet piles 22 for the retaining walls are struck on substantially the entire periphery of the vertical shaft 21 but, in this case, a concrete wall 23 for the retaining wall is cast or installed particularly on the tunneling starting direction side. Further, a sheet pile 24 is struck outside the concrete wall 23, that is, along the contact surface of the concrete wall 23 with the ground E, and a starting port 26 of a diameter a little larger than that of the tunneling machine 25 is then made in the concrete wall 23. Then, a substantially ring-shaped channel member 27 is fixed on the vertical shaft 21 side along the end edge of the concrete wall 23 on the periphery of the starting port 26, a substantially ring-shaped packing member 28 made of an elastic material such as a plate-shaped rubber or the like is fixed inside the channel member 27 so as to extend at the free end toward the center of the starting shaft port 26 so that when the tunneling head of the tunneling machine 25 is inserted into the starting shaft port 26, a liquid-tight space 29 will be formed by the head of the tunneling machine, packing member 28, channel 27, concrete wall 23 and sheet pile 24 and is made a pressurized liquid chamber for starting the tunneling machine in the same manner as in the embodiment of FIG. 1.

In propelling the tunneling machine 25 into the soft ground E, a slurry or muddy water 32 is fed into the liquid-pressurized chamber 29 through a feed pipe 30 feeding a slurry or muddy water under an elevated pressure for tunneling into a liquid-pressurized chamber 31 at the head part of the tunneling machine 25, the sheet pile 24 is pulled up to expose the port 26 so that the slurry or muddy water in the liquid-pressurized chamber 29 will communicate with the underground water in the ground E, and the tunneling machine 25 is propelled to begin the tunneling.

In the drawing, further, 33 is an outlet pipe for the slurry or muddy water with excavated soil or mud, 34 is a machine base, 35 is a group of jacks set between the rear end of the tunneling machine 25 and the sheet pile 22 to propel the tunneling machine into the ground, and 36 are jacks fixed at their cylinder side to the inside surface of the tunneling machine to further propel the tunneling machine by contacting their plunger ends with tunnel wall segments (not illustrated) inserted behind the tunneling machine after the machine advances.

In the embodiment of FIG. 2 as described above, it will be understood that the order of providing the concrete wall 23 and sheet pile 24 may be reversed, so that the sheet pile 24 will be preliminarily struck and thereafter the concrete wall 23 may be cast so as to form the starting port 26 from the beginning. Also, in this embodiment, the same as in the case of the embodiment in FIG. 1, the path for leading a slurry, muddy water or even water under a pressure into the pressurized liquid chamber 29 can be provided separately from the feed pipe 30 in a proper manner.

According to the present invention, in the case of first propelling a tunneling machine into a soft and unstable ground layer containing much water or having much gushing water, the shield slurry or muddy water pressure chamber is formed in advance in a starting port at the front end of the tunneling machine so as to retain a liquid pressure which can resist the underground water pressure, the sheet pile is then pulled up so as to place the pressurized liquid chamber in the starting port and the high water pressure ground in communication with each other as the tunneling machine is started into the ground, so that auxiliary processes for preliminarily improving the ground as in the conventional method can be effectively omitted. Accordingly it is possible to simplify the tunneling starting method thus to shorten the working period and lower its working costs without causing any danger of the soft ground collapse or gushing water outflow.

While the present invention has been detailed with reference to the preferred embodiments as shown in the drawings, it should be understood that the intention is not to limit the invention to those particular embodiments but rather to include all possible alterations, modifications and equivalent arrangements within the scope of the appended claims.

What is claimed is:

1. A method of starting a propulsion of a tunneling machine into a soft ground from a vertical shaft at the starting point beyond a retaining wall of the shaft, which comprising steps of a. providing a second wall having a starting port for the machine inside said retaining wall at a position from where the machine is propelled into the ground, b. defining a liquid-tight chamber inside the shaft at said starting port with the head part of the machine placed substantially in the starting port, c. feeding a liquid to said liquid-tight chamber under a pressure at least equal to a pressure applied to the retaining wall from the ground, d. removing the retaining wall out of the starting port to expose the ground and apply said pressure in the liquid-tight chamber to the exposed ground, and e. propelling the machine into the ground.

2. A method according to claim 1 wherein said step of providing the second wall comprises a step of securing a concrete block having said starting port to the retaining wall.

3. A method according to claim 1 wherein said step of providing the second wall comprises a step of securing a concrete block to the retaining wall, said block having said starting port and a liquid leading path allowing a pressurized liquid to be fed inside the starting port.

4. A method according to claim 1 wherein said step of providing the second wall comprises steps of striking a sheet pile having said starting port into the ground inside along the retaining wall and securing a substantially ring-shaped concrete block to said sheet pile around the starting port.

5. A method according to claim 1 wherein said step of providing the second wall comprises a step of casting a concrete wall inside along the retaining wall while forming said starting port.

6. A method according to claim 1 wherein said step of providing the second wall comprises steps of casting a concrete wall inside along the retaining wall and forming said starting port in said concrete wall.

7. A method according to claim 1 wherein said step of defining the liquid-tight chamber comprises steps of mounting a resilient packing means around said starting port so as to extend toward the center of the port and placing the head part of the tunneling machine in the port so that peripheral space around the machine's head part in the port will be liquid-tightly sealed by said packing means.

8. A method according to claim 1 wherein said liquid is selected from a group consisting of slurry, muddy water and water.

9. A method according to claim 1 wherein said pressure of the liquid in said liquid-tight chamber is higher than the pressure applied to the retaining wall from the ground.

10. A method of initially propelling a tunneling machine into a soft ground high in water content from a vertical shaft dug at the starting point of a tunnel and of which vertical peripheral walls are retained stable by sheet piles, said method comprising steps of providing a second wall having a starting port for allowing said tunneling machine to pass therethrough inside along said sheet piles in a liquid-tight manner at a position from where the machine is to be propelled into the ground, mounting a resilient liquid-tight packing around said starting port so as to extend toward the center of the port, placing the head part of the machine in the port so that peripheral space around the machine in the port will be liquid-tightly shielded by said packing, feeding a slurry into said shielded space under a pressure at least equal to a ground water pressure in the ground, removing the sheet piles facing the starting port to expose the ground and applying said pressure in the shielded space to the ground, and propelling the machine into the ground to initiate the tunneling while maintaining said pressure.

11. A method according to claim 10 wherein said step of feeding the slurry into the shielded space is performed through a slurry leading path provided in the second wall.

12. A method according to claim 10 wherein said step of feeding the slurry into the shielded space is performed by means of a slurry feeding and draining system connected to a pressurized slurry chamber at the head of said tunneling machine.

13. An apparatus for sealing in a liquid-tight manner a space in front of and peripherally around a tunneling machine when the machine is initially propelled into a soft ground high in water content from a vertical shaft made at a starting point of a tunnel to be excavated in the ground, said apparatus comprising a wall element provided liquid-tightly inside along a retaining wall of the shaft and having a starting port for allowing the tunneling machine to pass through said wall element, a resilient packing means fixed to said wall element around said starting port so as to extend toward the center of the port so that when the head part of the tunneling machine is inserted in the starting port said packing means will resiliently engage the peripheral surface of the tunneling machine and will define said liquid-tight space in front of and peripherally around the machine, and means for feeding a liquid under a pressure at least equal to that of ground water in the ground to be excavated into the liquid-tight space to stably retain the soft ground exposed when the retaining wall adjacent the wall element is removed for propelling the machine into the ground.

14. An apparatus according to claim 13 wherein said wall element is a sheet pile having said starting port and struck into the ground inside the vertical shaft along the retaining wall, and said packing means is fixed to said sheet pile through a substantially ring-shaped concrete block secured around the starting port.

15. An apparatus according to claim 14 wherein said liquid feeding means is a slurry leading path provided in said concrete block to communicate said liquid-tight space with a pressurized slurry source.

16. An apparatus according to claim 13 wherein said wall element is a concrete wall cast inside the shaft along the retaining wall so as to have said starting port.

17. An apparatus according to claim 16 wherein said packing means is fixed to said concrete wall through a substantially ring-shaped angle member.

* * * * *